US008918916B1

(12) United States Patent
Kang

(10) Patent No.: US 8,918,916 B1
(45) Date of Patent: Dec. 30, 2014

(54) HAT ACCESSORY

(71) Applicant: Harrison Kang, Long Beach, CA (US)

(72) Inventor: Harrison Kang, Long Beach, CA (US)

( * ) Notice: Subject to any disclaimer, the term of this patent is extended or adjusted under 35 U.S.C. 154(b) by 0 days.

(21) Appl. No.: 13/950,006

(22) Filed: Jul. 24, 2013

(51) Int. Cl.
*A42B 1/00* (2006.01)
*A41D 27/08* (2006.01)

(52) U.S. Cl.
CPC ..... *A42B 1/004* (2013.01); *A41D 27/08* (2013.01)
USPC ..... 2/175.6; 2/207; 2/209.13; 2/171

(58) Field of Classification Search
CPC ..... A42B 1/004; A41D 27/08
USPC ..... 2/184.5, 202, 207, 209, 13, 175.6, 171
See application file for complete search history.

(56) References Cited

U.S. PATENT DOCUMENTS 5,153,943 A * 10/1992 Clement ..... 2/418
5,355,535 A * 10/1994 Bruder ..... 2/172
5,400,440 A * 3/1995 Clifford ..... 2/172
5,448,778 A * 9/1995 Phillips ..... 2/172
5,906,006 A * 5/1999 Castro, Jr. ..... 2/207
6,247,180 B1 * 6/2001 Heinz ..... 2/171
6,260,204 B1 * 7/2001 Morrissey ..... 2/172
6,789,268 B2 * 9/2004 Yan ..... 2/209.13
6,802,083 B2 * 10/2004 Yan ..... 2/209.13
7,310,829 B1 * 12/2007 Engel-Wilson et al. ..... 2/209.13
7,343,630 B2 * 3/2008 Lee ..... 2/175.6
2003/0212995 A1 * 11/2003 Kitamori ..... 725/41
2004/0139530 A1 * 7/2004 Yan ..... 2/209.13

OTHER PUBLICATIONS

Krynski, William, PCT Notification of Transmittal of the International Search Report and the Written Opinion of the International Searching Authority, or the Declaration; Aug. 25, 2014, pp. 1-9.

* cited by examiner

*Primary Examiner* — Gloria Hale
(74) *Attorney, Agent, or Firm* — Stetina Brunda Garred & Brucker

(57) ABSTRACT

An accessory for a hat is disclosed which a wearer can use to show support for a team, cause or event and/or to protect the wearer from rain and damaging UV rays. In particular, the hat accessory may receive a protective covering with printed indicia on the exterior surface thereof. The protective covering may also be coated with a water repellent and also embedded with a treatment for UV protection. The protective covering may be removably attachable to the hat accessory so that the wearer can show support to a particular team, event or cause depending on the circumstances.

9 Claims, 2 Drawing Sheets

HAT ACCESSORY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various embodiments and aspects disclosed herein relate to an accessory for a hat for displaying printed indicia on a covering and/or for protecting the neck of the wearer from sunburn.

Fans at sporting stadiums like to display or show support for a team. To this end, fans will paint their bodies, carry paraphernalia associated with the team or other signs to indicate support for a particular team. Moreover, these fans may subject themselves to rain, sun and the weather in order to show support for their team. Accordingly, fans will expose themselves to extreme conditions in order to show support for their team.

Accordingly, there is a need in the art for an improved device for showing support for a particular team while helping to protect the wearer from elements of the weather.

BRIEF SUMMARY

The embodiments discussed herein address the needs discussed above, discussed below and those that are known in the art.

An accessory for a hat is disclosed which can be removably attachable to a hat and also can receive a protective covering. The protective covering may have printed indicia on the exterior surface thereof so that the wearer can show support to a particular team, event or cause or other reason. Also, the protective covering may have a coating to repel water and/or protect the wearer from damaging UV rays. The hat accessory may have a fastener for securing the hat accessory to a peak of the hat when desired.

More particularly, an accessory for a hat having a peak is disclosed. The accessory may comprise an elongate member, a left fastener, right fastener and a protective covering. The elongate member may be disposed behind a head of a wearer with left and right distal end portions positioned adjacent to temples of the wearer. The left fastener may be pivotably attached to the left distal end portion of the elongate member and securable to a left side of the peak of the hat. The right fastener may be pivotably attached to the right distal end portion of the elongate member and securable to a right side of the peak of the hat. The protective covering may be secured to the elongate member so that the protective covering may cover a neck of the wearer.

The elongate member may be fabricated from a plastic injection molded material.

The left fastener may be pivotably attached to the left distal end portion of the elongate member with a left ball and joint connection. Likewise, the right fastener may be attached to the right distal end portion of the elongate member with a right ball and joint connection.

The left fastener may have a slotted configuration for clipping the left fastener onto a left portion of an outer peripheral edge portion of the peak of the hat. Likewise, the right fastener may have a slotted configuration for clipping the right fastener onto a right portion of the outer peripheral edge portion of the peak of the hat.

The left and right fasteners may have a flared opening to assist in receiving outer peripheral portion of the peak.

The left fastener may be slideably connected to the left distal end portion of the elongate member for adjusting a position of the left fastener based on a size of the peak of the hat. Likewise, the right fastener may be slideably connected to the right distal end portion of the elongate member for adjusting a position of the right fastener based on the size of the peak of the hat. The sliding connection may formed from a plurality of detents which stop a catch to fix the position of the left and right fasteners.

The protective covering may be changed out to customize a printed indicia on an exterior surface of the protective covering.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
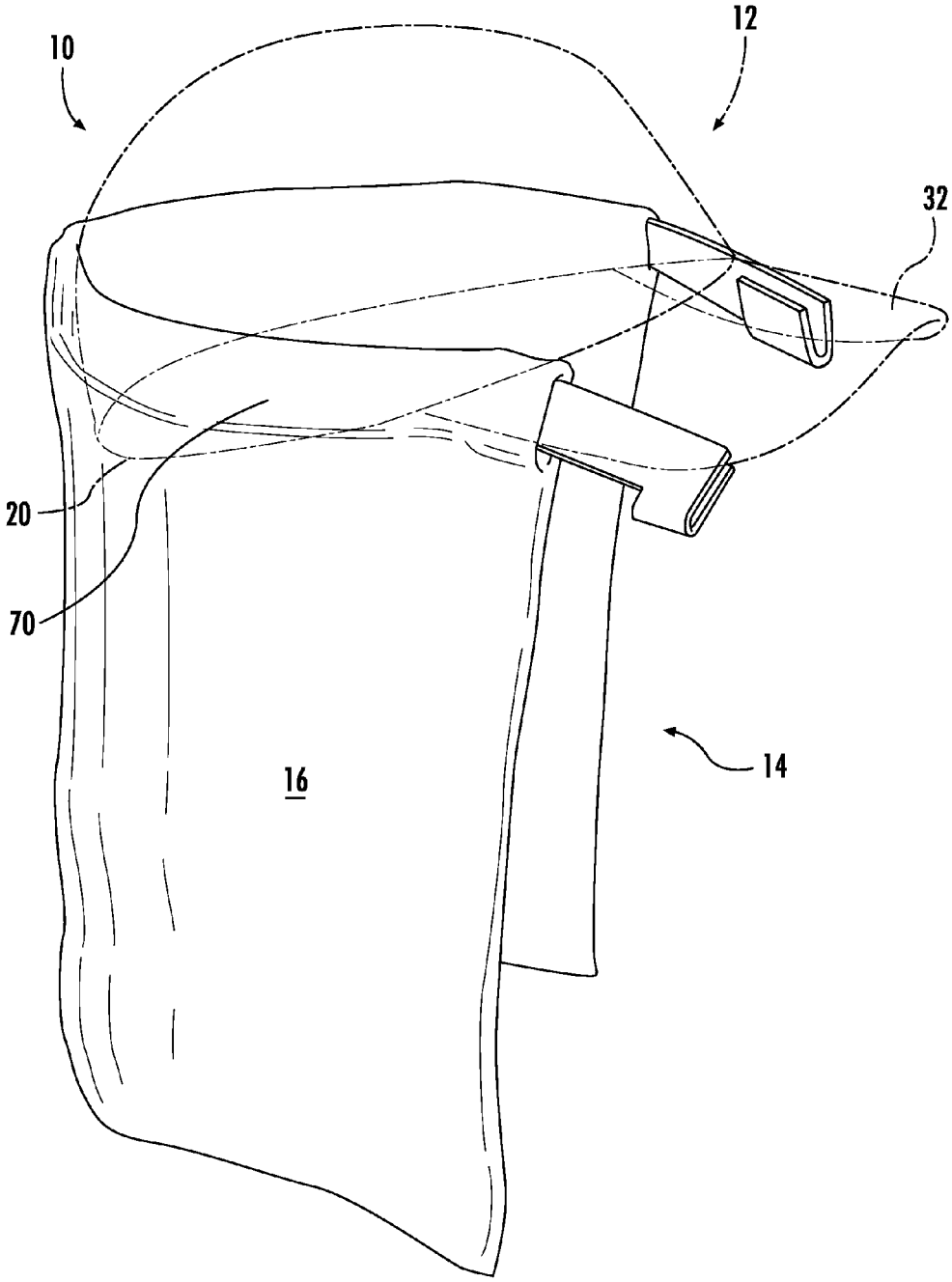
FIG. 1 is a perspective view of a hat accessory and a protective covering mounted to a hat.
Figure 2:
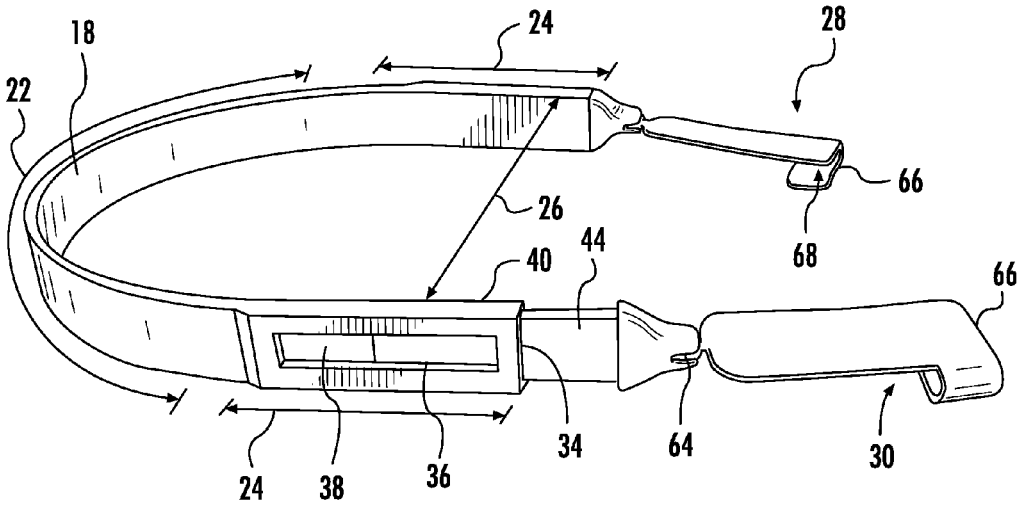
FIG. 2 is a perspective view of the hat accessory shown in FIG. 1.

Referring now to the drawings, a hat accessory 10 is shown which can be removably attachable to a hat 12. The hat accessory 10 allows the wearer to mount a covering 14 to the hat accessory 10 for the purposes of 1) displaying printed indicia on an exterior side 16 of the covering 14 and/or 2) covering the neck of the wearer to protect the neck from harmful UV rays.

The hat accessory 10 may have an elongate member 18. The elongate member 18 may have a U-shaped configuration to cradle a backside of the wearer's head. When the hat accessory 10 is attached to the hat 12, the elongate member 18 hugs the lower peripheral portion 20 of the hat 12. In this manner, the covering 14 would appear to be an extension of the hat 12. The elongate member 18 may have a curved middle portion 22 which matches the curvature of a backside of a human head. Straight portions 24 extend from the opposed ends of the curved middle portion 22 and are positioned adjacent to the temples of the wearer. The elongate member 18 may be fabricated from a plastic material that can be injection molded. The elongate member 18 may hold its shape when not in use. However, when the hat accessory 10 is worn by the wearer, the straight portions 24 may be made wider or narrower 26 compared to a width of the wearer's head. The straight portions 24 of the elongate member 18 may be brought closer together or spread apart so that the hat accessory 10 can fit around the wearer's head. To this end, the elongate member 18 may be sufficiently rigid to provide support for the covering 14 when the covering 14 is mounted to the elongate member 18 so that the elongate member 18 does not sag when the covering 14 is mounted thereto. However, the elongate member 18 can be slightly spread (i.e., flexible) apart to accommodate wearers with wider heads or compressed slightly for wearers with narrower heads. The elongate member 18 may be kept in position on the hat 12 by way of left and right fasteners 28, 30 which are secured to a peak 32 of the hat 12 as discussed below.

The straight distal end portions 24 of the elongate member 18 may each have a slot 34 that extends longitudinally through the straight distal end portions 24 of the elongate member 18. A window 36 is formed on the exterior side 16 of the straight distal end portions 24 to view the position of the left and right fasteners 28, 30. The interior surface 38 of an interior wall 40 of the straight distal end portion 24 may have a ridge that engage one of the dimples 42 formed in an extension member 44 so that the position of the fasteners 28, 30 may be adjusted to fit a particular hat size.

Figure 3:
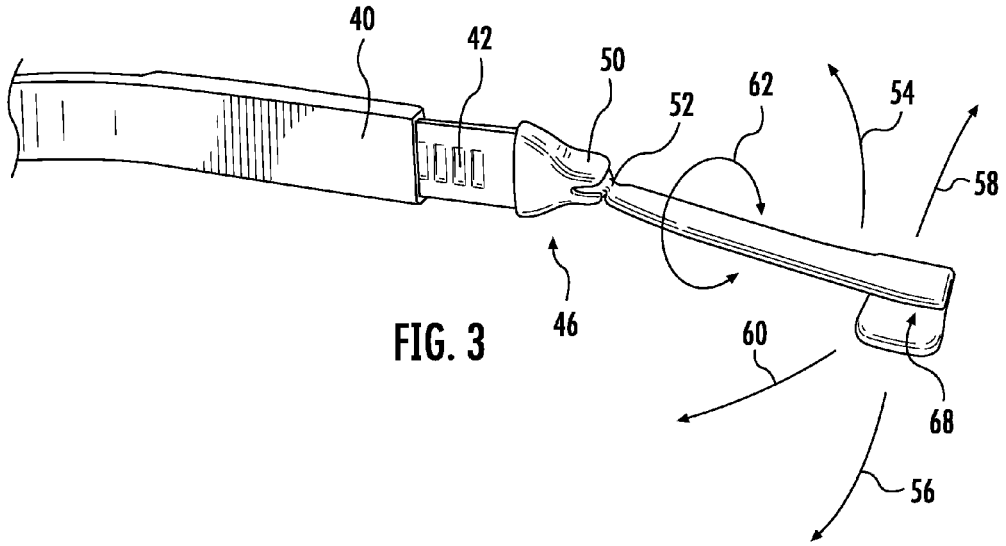
FIG. 3 is an enlarged view of a distal end portion of an elongate member and a fastener of the hat accessory shown in FIG. 1.

Additionally, the fasteners 28, 30 may be pivotally connected to the extension member 44. The extension member 44 may be inserted into the slot 34 of the straight distal portion 24 and can telescope further into or further out of the straight distal portion 24 to position the fastener. The dimples 42 are formed on the extension member 44 as shown in FIG. 3. The proximal end portion 46 of the extension member 44 may be formed with the joint 48 that has a spherical cavity 50 which is sized and configured to receive a ball 52 to allow the fastener 28, 30 to pivot upward 54, downward 56, left 58 and right 60 as well as rotate 62. The ball 52 and joint 48 allow the fasteners 28, 30 to be adjusted so to be secured to the peak 32 of the hat 12 regardless of its style (e.g., curved, flat, etc.). The ball 52 and joint 48 may be sized and configured to have a friction fit on the peak 32 of the hat 12 so that once the fasteners 28, 30 are positioned, they do not move unless forced to do so. Moreover, the joint 48 may have a split configuration 64 to allow the ball 52 to spread open the joint 48 then collapse the joint 50 onto the ball 52 to retain the fasteners 28, 30 on the extension members 44.

The left and right fasteners 28, 30 may have clips 66. The clips 66 may have a flared opening 68 to assist the wearer in inserting the peripheral edge portion of the peak 32 of the hat 12 into the clips 66. When the left and right fasteners 28, 30 are adjusted to be mounted onto the peak 32 of the hat 12, the ball and joint 52, 48 connection between the left and right fasteners 28, and the extension members 44 holds the position of the left and right fasteners 28, 30.

The hat 12 is shown as being a baseball cap in FIG. 1. However, other types of hats 12 are also contemplated. By way of example and not limitation, the hat accessory 10 may be used in conjunction with a baseball cap as shown in FIG. 1, a flat bill cap and other hat configurations which are known in the art or developed in the future.

In use, the wearer may be provided with a covering 14. The covering 14 may have a seam 70 which provides for a channel formed at the upper peripheral portion of the covering 14. The hat accessory 10 is fed through the seam 70 as shown in FIG. 1. The covering 14 covers the elongate member 18. The left and right fasteners 28, 30 protrude out of the seam 70 and may be adjusted to be secured to the peak 32 of the hat 12. Once the covering 14 is on the hat accessory 10, the left and right fasteners 28, 30 are adjusted so that the clips 66 can be attached to the left and right portions of the peak 32. When the wearer wears the hat 12, the covering 14 may have printed indicia for the purpose of showing support for a sports team, cause or other event. The printed indicia may be screen printed on the exterior surface of the covering 14 or applied thereto via methods known in the art or developed in the future. Additionally or alternatively, the covering 14 may be coated to provide protection from the environment. By way of example, the covering 14 may be coated with a water repellant or a UV protectant. It is also contemplated that the material used to fabricate the covering 14 be embedded with a UV inhibitor or protectant and/or water repellant or other chemical or product for providing protection from the environment.

Since the hat accessory 10 can be removably secured to the hat 12, the hat accessory 10 can be mounted to the hat 12 at a baseball stadium, football stadium or other sporting event to show support for the favored team.

The hat accessory 10 may also be used for the purpose of providing protection to the wearer's neck. The covering 14 may be sufficiently long to extend from the lower peripheral portion 20 of the hat 12 to below the neckline of the wearer.

The above description is given by way of example, and not limitation. Given the above disclosure, one skilled in the art could devise variations that are within the scope and spirit of the invention disclosed herein, including various ways of adjusting the position of the fasteners 28, 30. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An accessory for a hat having a peak, the accessory comprising:

an elongate rigid member disposable behind a head of a wearer with left and right distal end portions positionable adjacent to temples of the wearer, the left and right distal end portion being extendible to adjust for various sized hats;

a left fastener pivotably attached to the left distal end portion of the elongate member to adjust for various sized and shaped peaks and securable to a left side of the peak of the hat;

a right fastener pivotably attached to the right distal end portion of the elongate member to adjust for various sized and shaped peaks and securable to a right side of the peak of the hat;

a protective covering securable to the elongate member so that the protective covering may cover a neck of the wearer.

2. The accessory of claim 1 wherein the elongate member is fabricated from a plastic injection molded material.

3. The accessory of claim 1 wherein the left fastener is pivotably attached to the left distal end portion of the elongate member with a left ball and joint connection, and the right fastener is attached to the right distal end portion of the elongate member with a right ball and joint connection.

4. The accessory of claim 1 wherein the left fastener has a slotted configuration for clipping the left fastener onto a left portion of an outer peripheral edge portion of the peak of the hat, and the right fastener has a slotted configuration for clipping the right fastener onto a right portion of the outer peripheral edge portion of the peak of the hat.

5. The accessory of claim 1 wherein the left and right fasteners have a flared opening to assist in receiving the outer peripheral portion of the peak.

6. The accessory of claim 1 wherein the left fastener is slideably connected to the left distal end portion of the elongate member for adjusting a position of the left fastener based on a size of the peak of the hat, and the right fastener is slideably connected to the right distal end portion of the elongate member for adjusting a position of the right fastener based on the size of the peak of the hat.

7. The accessory of claim 6 wherein the sliding connection has a plurality of detents which stop a catch to fix the position of the left and right fasteners.

8. The accessory of claim 1 wherein the protective covering may be changed out to customize a printed indicia on an exterior surface of the protective covering.

9. A hat accessory kit having a hat in combination with an accessory, the kit comprising:

the hat having a peak; and the accessory for the hat as recited in claim 1.

* * * * *